US010950402B2

(12) United States Patent
Schumacher

(10) Patent No.: US 10,950,402 B2
(45) Date of Patent: Mar. 16, 2021

(54) ELECTRICAL CONTACTOR

(71) Applicant: SolarBOS, Inc., Livermore, CA (US)

(72) Inventor: Coel Schumacher, Auburn, CA (US)

(73) Assignee: SOLARBOS, INC., Livermore, CA (US)

( * ) Notice: Subject to any disclaimer, the term of this patent is extended or adjusted under 35 U.S.C. 154(b) by 161 days.

(21) Appl. No.: 16/157,667

(22) Filed: Oct. 11, 2018

(65) Prior Publication Data

US 2019/0115177 A1 Apr. 18, 2019

Related U.S. Application Data

(60) Provisional application No. 62/573,286, filed on Oct. 17, 2017.

(51) Int. Cl.

| | |
|---|---|
| ***H01H 3/00*** | (2006.01) |
| ***H01H 50/02*** | (2006.01) |
| ***H01H 51/29*** | (2006.01) |
| ***H01H 50/54*** | (2006.01) |
| ***H01H 50/14*** | (2006.01) |

(52) U.S. Cl.

CPC ..... *H01H 50/026* (2013.01); *H01H 50/14* (2013.01); *H01H 50/546* (2013.01); *H01H 51/29* (2013.01); *H01H 2239/018* (2013.01)

(58) Field of Classification Search

CPC ..... H01H 50/026; H01H 50/14; H01H 50/546
USPC ..... 335/192
See application file for complete search history.

(56) References Cited

U.S. PATENT DOCUMENTS

| | | | | |
|---|---|---|---|---|
| 3,207,252 | A * | 9/1965 | Cripe | G01P 3/56 180/174 |
| 3,350,234 | A | 10/1967 | Ule | |
| 3,459,052 | A * | 8/1969 | Bemmann | B60K 31/102 73/506 |
| 3,597,122 | A * | 8/1971 | Farmer | F04B 39/0016 417/417 |
| 4,964,713 | A | 10/1990 | Goetzberger | |
| 5,498,297 | A | 3/1996 | ONeill | |
| 5,527,191 | A | 6/1996 | Bevis | |
| 5,892,422 | A * | 4/1999 | Montaigu | H01H 51/065 335/126 |
| 6,215,636 | B1 | 4/2001 | Hellemans | |
| 6,376,774 | B1 | 4/2002 | Oh | |
| 6,377,143 | B1 * | 4/2002 | Zhou | H01H 50/546 218/154 |
| 6,472,878 | B1 | 10/2002 | Bruchmann | |

(Continued)

FOREIGN PATENT DOCUMENTS

| | | |
|---|---|---|
| EP | 2742589 | 6/2014 |
| EP | 2499710 | 7/2014 |

(Continued)

OTHER PUBLICATIONS

"HomeRun Disconnecting Combiner Boxes" web page, published before Jul. 13, 2010, 1 page.

(Continued)

*Primary Examiner* — Shawki S Ismail
*Assistant Examiner* — Lisa N Homza
(74) *Attorney, Agent, or Firm* — Niels Haun; Dann, Dorfman, Herrell & Skillman, P.C.

(57) ABSTRACT

An electrical contactor, and more particularly, but not exclusively, contactors having improved noise performance.

5 Claims, 3 Drawing Sheets

(56) References Cited

U.S. PATENT DOCUMENTS 6,545,211 B1 4/2003 Mimura
6,700,466 B1 * 3/2004 Yamamoto ..... H01H 9/443 335/132
6,738,246 B1 5/2004 Struempler
6,966,184 B2 11/2005 Toyomura
7,057,311 B1 6/2006 Zhou
8,502,416 B2 8/2013 Falk
8,558,709 B2 10/2013 Schripsema
8,653,913 B2 * 2/2014 Vellaiyanaicken .. H01H 1/2025 335/126
8,653,917 B2 * 2/2014 Takaya ..... H01H 9/443 335/201
2001/0023703 A1 9/2001 Kondo
2002/0038667 A1 4/2002 Kondo
2003/0075211 A1 4/2003 Makita
2004/0174664 A1 9/2004 Werner
2009/0168277 A1 7/2009 Changali
2009/0207543 A1 8/2009 Boniface
2011/0073150 A1 3/2011 Hightower
2011/0090607 A1 4/2011 Luebke
2011/0121984 A1 5/2011 Schripsema
2011/0273015 A1 11/2011 Adest
2012/0326815 A1 * 12/2012 Suzuki ..... H01H 50/546 335/185
2013/0057997 A1 3/2013 Dent
2013/0229248 A1 * 9/2013 Yokoyama ..... H01H 9/346 335/201
2013/0328647 A1 * 12/2013 Naka ..... H01H 50/58 335/189
2014/0014622 A1 * 1/2014 Naka ..... H01H 51/065 218/4
2014/0062627 A1 * 3/2014 Naka ..... H01H 50/54 335/189
2014/0176268 A1 * 6/2014 Suzuki ..... H01H 9/443 335/201
2014/0184366 A1 * 7/2014 Ito ..... H01H 50/546 335/189
2014/0226242 A1 8/2014 Schripsema
2014/0360985 A1 * 12/2014 Takaya ..... H01H 50/02 218/156
2015/0015350 A1 * 1/2015 Tachikawa ..... H01H 50/18 335/131
2015/0022292 A1 * 1/2015 Tachikawa ..... H01H 49/00 335/131
2015/0034600 A1 * 2/2015 Isozaki ..... H01H 9/443 218/148
2015/0103454 A1 4/2015 Schripsema
2015/0187518 A1 * 7/2015 Molyneux ..... H01H 50/546 335/154
2015/0194801 A1 7/2015 Schripsema
2015/0213969 A1 * 7/2015 Naka ..... H01H 50/546 200/304
2015/0213984 A1 * 7/2015 Naka ..... H01H 50/546 335/196
2015/0255235 A1 * 9/2015 Nishimura ..... H01H 50/546 335/187
2016/0079017 A1 * 3/2016 Priest ..... H01H 33/182 218/26
2016/0189901 A1 * 6/2016 Tsutsumi ..... H01H 50/36 335/84
2016/0254113 A1 * 9/2016 Nishimura ..... H01H 50/02 335/202
2016/0293370 A1 * 10/2016 Tsutsumi ..... H01H 50/641
2016/0300676 A1 * 10/2016 Sakai ..... H01H 50/546
2018/0144893 A1 * 5/2018 Konishi ..... H01H 50/541
2018/0144894 A1 * 5/2018 Takaya ..... H01H 50/02
2018/0158635 A1 * 6/2018 Tashima ..... H01H 50/546
2018/0197707 A1 * 7/2018 Takaya ..... H01H 50/02
2018/0286614 A1 * 10/2018 Morikawa ..... H01H 50/023
2019/0066956 A1 * 2/2019 Konishi ..... H01H 1/58
2019/0115177 A1 * 4/2019 Schumacher ..... H01H 51/29
2019/0131093 A1 * 5/2019 Minowa ..... H01H 50/14
2019/0131094 A1 * 5/2019 Minowa ..... H01H 50/18
2019/0131095 A1 * 5/2019 Minowa ..... H01H 50/04
2019/0131096 A1 * 5/2019 Minowa ..... H01H 50/641
2019/0131097 A1 * 5/2019 Minowa ..... H01H 50/04
2019/0326085 A1 * 10/2019 Lee ..... H01H 50/56
2019/0355536 A1 * 11/2019 Ozaki ..... H01H 50/44
2020/0051766 A1 * 2/2020 Lee ..... H01H 50/54
2020/0075277 A1 * 3/2020 McTigue ..... H01H 39/006
2020/0126741 A1 * 4/2020 Lee ..... H01H 9/443

FOREIGN PATENT DOCUMENTS

EP 2870669 5/2015
JP H09113561 5/1997
JP 2001320827 11/2001
JP 2011101537 A 5/2011
KR 100996627 11/2010
KR 100999978 12/2010
RU 100282 12/2010
WO 2008125915 10/2008
WO 2011057255 5/2011
WO 2013049501 4/2013
WO 2014011593 1/2014

OTHER PUBLICATIONS

FHS 40-P/SP600 Minisens, http://www.lem.com/docs/products/fhs%2040-p%20sp600.pdf, publsihed before Nov. 9, 2010, 18 pages.
International Search Report dated Jul. 29, 2011 for corresponding International Application No. PCT/US2010/056006.
International Search Report dated Mar. 11, 2013 for International Application No. PCT/US2012/057816.
International Search Report dated Oct. 18, 2013 in corresponding International Application No. PCT/US2013/049658.
Written Opinion dated Oct. 18, 2013 in corresponding International Application No. PCT/US2013/049658.

* cited by examiner

ELECTRICAL CONTACTOR

RELATED APPLICATIONS

This is application claims the benefit of priority of U.S. Provisional Application No. 62/573,286, filed on Oct. 10, 2017, the entire contents of which application(s) are incorporated herein by reference.

FIELD OF THE INVENTION

The present invention relates generally to electrical contactors, and more particularly, but not exclusively, to electrical contactors having improved noise performance.

BACKGROUND OF THE INVENTION

Traditional contactor design is composed of three main parts: control circuitry, main contacts, and the mechanical housing. Typically the control circuitry is designed to avoid creating and/or inducing "noise" or other unwanted disturbances on the main contacts which may occur due to the windings of the electro-magnet that move the main contacts. The contactor may for instance may include a plunger that is electrically isolated from a contact bridging bar. (Gigavac, Model/PN: HX21CCC.) The ferrous parts (i.e., housing) of the contactor are typically not isolated from the main contacts. While ferrous parts are not isolated, they are also not intentionally connected. This allows ferrous parts to float at some voltage that may or may not be the same as the main contacts. Typically this is not a problem; however, if the main contact voltage fluctuates, it can change by enough (while the housing does not change with it) that at a certain point the potential between the two will be great enough for a spark (capacitive discharge) to jump and cause the housing voltage to jump to a voltage closer to that of the main contacts. This in turn can induce an unwanted voltage in the control circuit. Accordingly, there is a need in the art for contactors which avoid such problems.

SUMMARY OF THE INVENTION

In one of its aspects, the present invention may provide an improved electrical contactor in which the control circuit is isolated from the main contacts/circuit and in which a ferrous housing and other related ferrous parts are shielded from one another. Such an arrangement may also help to keep the main circuit from interfering with the control circuit. In such a situation, the contactor housing may also be grounded. In another of its aspects the present invention may provide an electrical contactor in which the main contacts are absolutely isolated from the housing to keep the housing from changing voltage drastically and unpredictably with undesirable effects on the control circuit. Alternatively, a main contact bridging bar may be electrically connected to the housing. In yet a further of its aspects, the present invention may provide an electrical contactor in which the housing is electrically connected to one of the poles of the main contacts to ensure that the housing voltage is held at the voltage of the main contacts and does not change unpredictably. In so doing, the typical double break main contacts will only break on a single contact so it may be preferred that the connection between the selected contact pole and housing be made through a high resistance to regain the full functionality of the two breaking contacts.

In view of the above, in one of its aspects the present invention may provide an electrical contactor, comprising a housing and a pair of electrical contacts mounted thereto, each contact having an end extending into the housing. The contactor may include a contact bridging bar movably positioned relative to the pair of electrical contacts such that the contact bridging bar contacts and electrically connects the pair of electrical contacts in a first position of the contact bridging bar. The contact bridging bar may be disposed out of contact with the pair of electrical contacts in a second position of the contact bridging bar. A plunger may be attached to the bridging bar, and coil windings may be disposed about the plunger. The coil windings may be configured to generate a magnetic field operable to move the plunger between first and second positions corresponding to the first and second positions of the contact bridging bar. In addition, either i) the plunger and contact bridging bar may be electrically isolated from one another and the housing connected to ground or ii) the plunger or a selected one of the pair of electrical contacts may electrically communicate with the housing. The housing may include a lower compartment in which the coil windings are disposed, and the lower compartment may include a ferrous wall disposed between the coils and the pair of electrical contacts. The ferrous wall may have an aperture with the plunger disposed therein. A conductive spring or a flexible conductive member may be connected to the plunger and the housing to provide electrical communication therebetween. The plunger or a selected one of the pair of electrical contacts may electrically communicate with the housing which is connected to ground.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1:
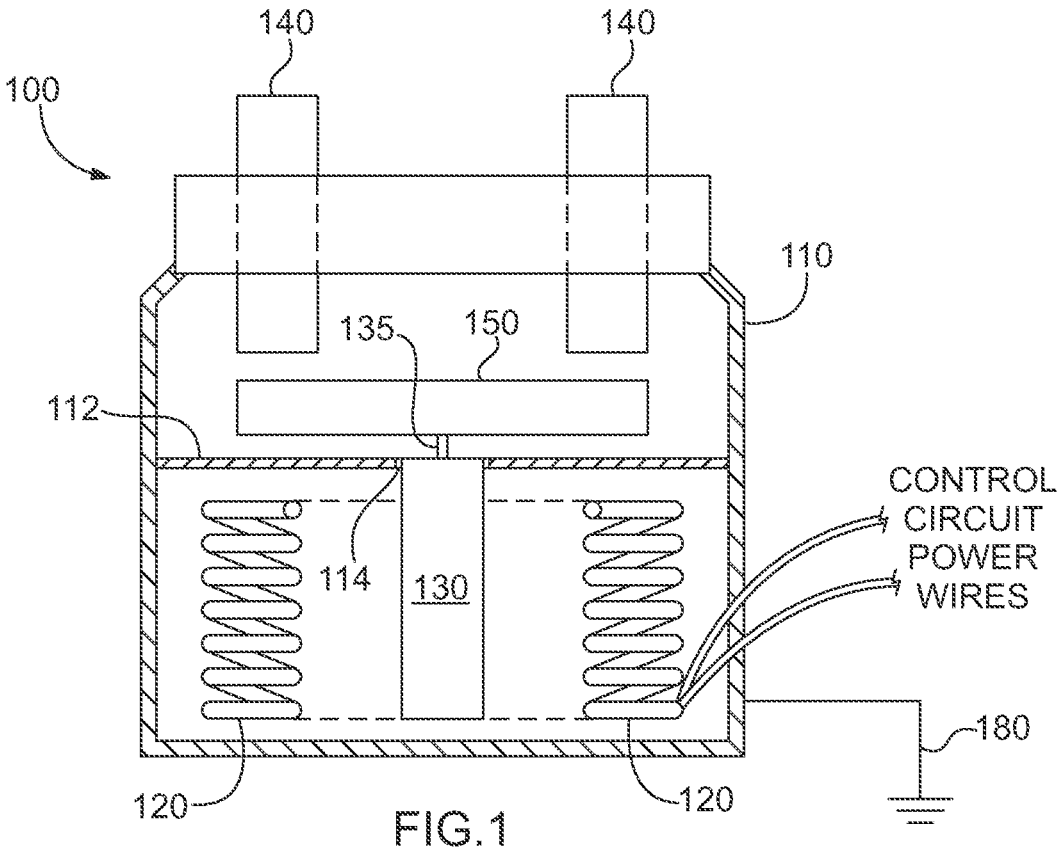
FIG. 1 schematically illustrates an exemplary configuration of an electrical contactor in accordance with the present invention having a contact bridging bar electrically isolated from a plunger with the housing grounded.

Referring now to the figures, wherein like elements are numbered alike throughout, FIG. 1 schematically illustrates an exemplary configuration of an electrical contactor 100 in accordance with the present invention. The contactor 100 may include a ferrous housing 110 having a lower compartment 116 defined by a ferrous wall 112 having an aperture 114 disposed therein. Coil windings 120 may be provided in the lower compartment 116 with a plunger 130 disposed between the coil windings and located within the aperture 114. The plunger 130 may be attached to a main contact bridging bar 150 via an electrically isolative material 135. The contactor 100 may also include a pair of main contacts 140. The plunger 130 may be configured to respond to a magnetic field created by the coil windings 120 to allow the plunger 130 to move between a first position and a second position within the housing 110. In particular, at a first position of the plunger 130, the main contact bridging bar 150 may be disposed in contact with the main contacts 140 to electrically connect the main contacts to one another. In a second position of the plunger 130, the main contact bridging bar 150 may be disposed out of contact with the main contacts 140 so the main contacts 140 are not in electrical communication with one another. The housing 110 may be grounded 180 to help ensure that the housing 110 stays at a constant voltage. By maintaining the housing 110 at a constant voltage and electrically isolating the main contact bridging bar 150 from the plunger 130, and thus the coil windings 120, extraneous electrical signals may be prevented from reaching the main contacts 140.

Figure 2:
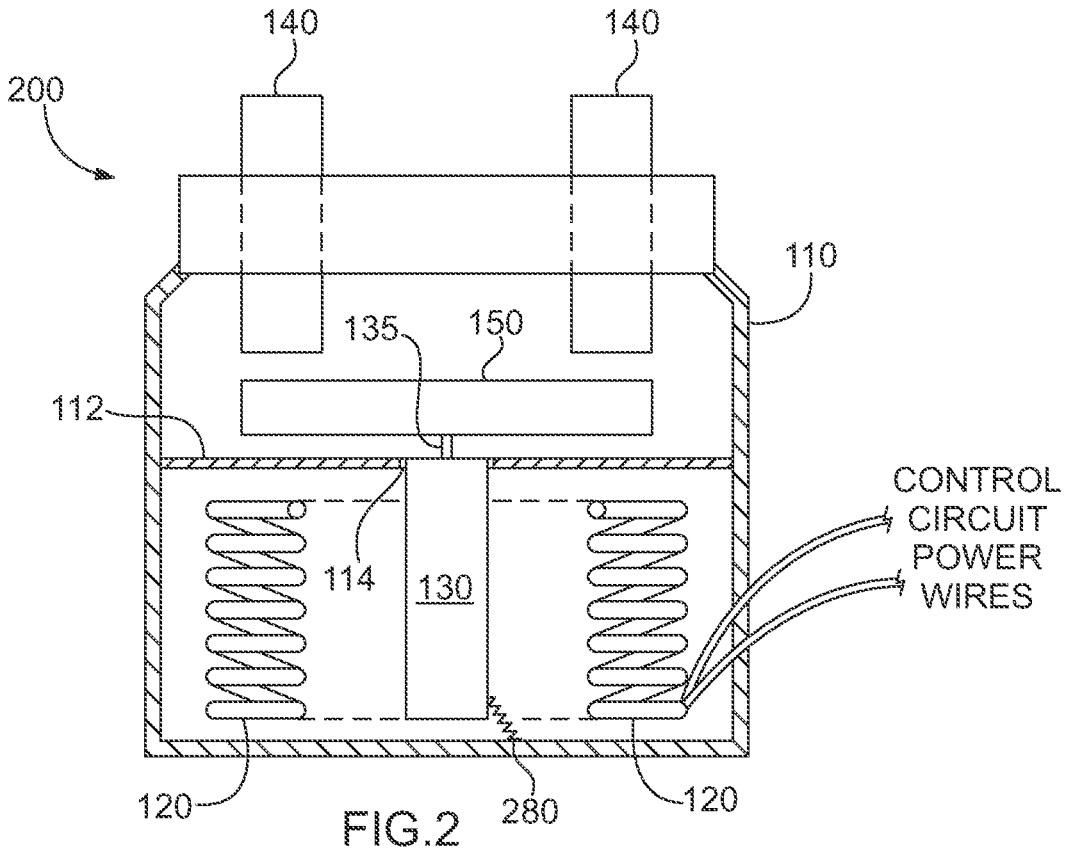
FIG. 2 schematically illustrates a further exemplary configuration of an electrical contactor in accordance with the present invention having a plunger electrically connected to the housing.
Figure 3:
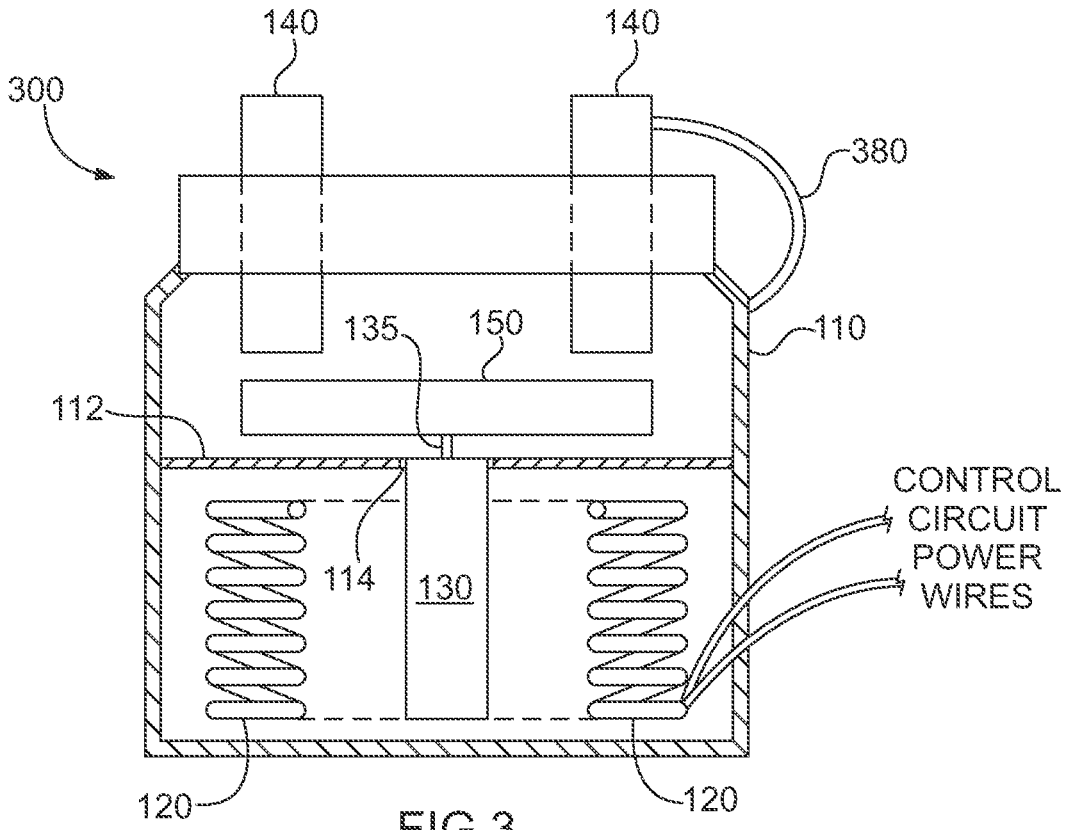
FIG. 3 schematically illustrates yet a further exemplary configuration of an electrical contactor in accordance with the present invention having a main contact electrically connected to the housing.

In a further exemplary configuration, the present invention may provide an electrical contactor 200 similar to that of the contactor 100 of FIG. 1, but having a conductive member 280 providing electrical communication between the plunger 130 and housing 110, FIG. 2. In such a configuration, it is not necessary to ground the housing 110 or to electrically isolate the main contact bridging bar 150 from the plunger 130. By electrically connecting the plunger 130 and housing 110, a voltage potential will not develop between the housing 110 in the plunger 130, and thus will not develop between the housing 110 and main contacts 140. Since the plunger 130 is movable, the conductive member 280 may be flexible and may include a spring, for example.

In a still further exemplary configuration, the present invention may provide an electrical contactor 300 also similar to that of the contactor 100 of FIG. 1, but having a conductive link 380 electrically connecting the main contacts 100 with the housing 110, possibly through a resistor so that the housing 110 stays at the same potential as the main contact 140 to which is connected. When the main contacts 140 are electrically connected to one another via the main contact bridging bar 150, both main contacts 140 will be at the same potential as the housing 110. The plunger 130 and main contact bridging bar 150 may be electrically isolated via the isolative material 135.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An electrical contactor, comprising:

a housing and a pair of electrical contacts mounted thereto, each contact having an end extending into the housing;

a contact bridging bar movably positioned relative to the pair of electrical contacts such that the contact bridging bar contacts the ends of the electrical contacts and electrically connects the pair of electrical contacts in a first position of the contact bridging bar and is disposed out of contact with the pair of electrical contacts in a second position of the contact bridging bar;

a plunger attached to the bridging bar; and coil windings disposed about the plunger, the coil windings configured to generate a magnetic field operable to move the plunger between first and second positions corresponding to the first and second positions of the contact bridging bar, wherein either i) the plunger and contact bridging bar are electrically isolated from one another and the housing is connected to ground or ii) the plunger or a selected one of the pair of electrical contacts electrically communicates with the housing.

2. The electrical contactor according to claim 1, wherein the housing includes a lower compartment in which the coil windings are disposed, the lower compartment including a ferrous wall disposed between the coils and the pair of electrical contacts, the ferrous wall having an aperture with the plunger disposed therein.

3. The electrical contactor according to claim 1, comprising a conductive spring connected to the plunger and the housing to provide electrical communication therebetween.

4. The electrical contactor according to claim 1, comprising a flexible conductive member connected to the plunger and the housing to provide electrical communication therebetween.

5. The electrical contactor according to claim 1, wherein the plunger or a selected one of the pair of electrical contacts electrically communicates with the housing, and wherein the housing is connected to ground.

* * * * *